US008720236B2

(12) United States Patent
Ling et al.

(10) Patent No.: US 8,720,236 B2
(45) Date of Patent: May 13, 2014

(54) PADLOCK

(75) Inventors: Renny Tse-Haw Ling, Chung-Ho (TW); Chun-Sheng Wu, Chung-Ho (TW)

(73) Assignee: Sinox Company Ltd. (TW)

( * ) Notice: Subject to any disclaimer, the term of this patent is extended or adjusted under 35 U.S.C. 154(b) by 1489 days.

(21) Appl. No.: 11/671,404

(22) Filed: Feb. 5, 2007

(65) Prior Publication Data

US 2007/0125141 A1 Jun. 7, 2007

Related U.S. Application Data

(63) Continuation of application No. 10/759,413, filed on Jan. 16, 2004, now Pat. No. 7,174,756.

(30) Foreign Application Priority Data

May 14, 2003 (TW) ..... 92208756 U

(51) Int. Cl.
*E05B 37/06* (2006.01)

(52) U.S. Cl.
USPC ..... 70/21; 70/25; 70/53; 70/54; 70/284; 70/285

(58) Field of Classification Search
USPC ..... 70/284, 285, 38 A, 50, 52–56, 21, 25–30
See application file for complete search history.

(56) References Cited

U.S. PATENT DOCUMENTS

| | | | |
|---|---|---|---|
| 32,563 | A | 6/1861 | Hirschbuhl |
| 124,189 | A | 2/1872 | Zeiler |
| 371,796 | A | 10/1887 | Smith et al. |
| 410,024 | A | 8/1889 | Richards |
| 426,734 | A | 4/1890 | Mosley |
| 718,359 | A | 1/1903 | Koerber |
| 771,092 | A | 9/1904 | Ramey |
| 883,571 | A | 3/1908 | Sahlsten |
| 941,028 | A | 11/1909 | Murphy |
| 972,171 | A | 10/1910 | Dupont |
| 999,044 | A | 7/1911 | Kuster |
| 1,001,104 | A | 8/1911 | Wayda |
| 1,052,627 | A | 2/1913 | Takimoto |
| 1,155,405 | A | 10/1915 | D'Angelo |
| 1,161,158 | A | 11/1915 | Rennert |
| 1,326,394 | A | 12/1919 | Dowe |
| 1,384,390 | A | 7/1921 | Judycki |

(Continued)

FOREIGN PATENT DOCUMENTS

| | | |
|---|---|---|
| CN | 2041340 U | 7/1989 |
| DE | 14697 | 8/1881 |

(Continued)

OTHER PUBLICATIONS

U.S. Appl. No. 11/420,687, filed May 26, 2006, Kuo et al.

(Continued)

*Primary Examiner* — Suzanne Barrett
(74) *Attorney, Agent, or Firm* — Sheridan Ross P.C.

(57) ABSTRACT

A multiple function lock, which has dual, independently operated, locking mechanisms. In one embodiment, the multiple function lock is further comprised of a combination locking mechanism and a keyed locking mechanism. In one embodiment, the multiple function lock is further comprised of a gate mechanism for selectively securing and releasing a shackle of the lock.

18 Claims, 18 Drawing Sheets

(56) References Cited

U.S. PATENT DOCUMENTS 1,597,560 A 8/1926 Wise
1,622,999 A 3/1927 Frith
1,667,254 A 4/1928 Hedrich
1,688,208 A 10/1928 Rosso
1,755,521 A 4/1930 Smith
1,816,951 A 8/1931 Anez
1,857,399 A 5/1932 Piagneri
1,897,922 A 2/1933 Bradshaw
1,937,523 A 12/1933 Machinist
1,981,163 A 11/1934 Carlson
2,001,262 A 5/1935 North
2,008,565 A 7/1935 Segal
2,049,416 A 8/1936 Aldeen
2,090,631 A 8/1937 Junkunc
2,110,094 A 3/1938 Pauloski
2,115,042 A 4/1938 Olson
2,159,291 A 5/1939 Quintal
2,163,852 A 6/1939 Pond
2,315,102 A 3/1943 Adams
2,357,305 A 9/1944 Barrett
2,378,768 A 6/1945 Heyer
2,487,608 A 11/1949 Soref et al.
2,497,619 A 2/1950 Adolph Mass
2,546,182 A 3/1951 Fenari
2,725,739 A 12/1955 Check
2,839,322 A 6/1958 Kirk
2,839,382 A 6/1958 Graef
2,923,928 A 2/1960 McLaughlin
2,926,514 A 3/1960 Junkunc
2,931,203 A 4/1960 Check
2,931,204 A 4/1960 Check
2,995,025 A 8/1961 Toepfer
3,009,345 A 11/1961 Check
3,050,977 A 8/1962 Foote et al.
3,349,584 A 10/1967 Russell et al.
3,408,839 A 11/1968 Walters
3,472,049 A 10/1969 Sewell
3,528,267 A 9/1970 Orr
3,546,906 A 12/1970 Yang
3,584,483 A 6/1971 Orr
3,702,551 A 11/1972 Blizard
3,720,082 A 3/1973 Feinberg et al.
3,729,962 A 5/1973 Harrington et al.
3,750,431 A 8/1973 Atkinson
3,808,848 A 5/1974 Yang
3,823,584 A 7/1974 Gill
3,824,819 A 7/1974 Neary
3,837,189 A 9/1974 Atkinson
3,894,415 A 7/1975 Bako
3,952,559 A 4/1976 Atkinson
4,030,321 A 6/1977 Kenyon
4,055,972 A 11/1977 Calegan
4,170,884 A 10/1979 Calegan
4,325,240 A 4/1982 Gable
4,444,029 A 4/1984 Remington
4,453,390 A 6/1984 Moritz et al.
4,462,231 A 7/1984 Zabel
4,490,999 A 1/1985 Castle et al.
4,532,785 A 8/1985 Uyeda
4,559,796 A 12/1985 De Forrest, Sr.
4,583,775 A 4/1986 Bisbing
4,609,780 A 9/1986 Clark
4,651,544 A 3/1987 Hungerford
4,671,088 A 6/1987 Jeang
4,683,738 A 8/1987 Berkowitz
4,730,467 A 3/1988 Lebrecht
4,733,548 A 3/1988 Ling
4,751,830 A 6/1988 Cheng
4,770,013 A 9/1988 Nakai
4,799,370 A 1/1989 Cooper
4,829,794 A 5/1989 Crown
4,829,795 A 5/1989 Taylor
4,851,652 A 7/1989 Imran
4,885,923 A 12/1989 Nakai
4,897,945 A 2/1990 Webb
4,901,057 A 2/1990 Suneborn
4,914,732 A 4/1990 Henderson et al.
4,961,330 A 10/1990 Evans
5,046,339 A 9/1991 Krell
D321,824 S 11/1991 Appelbaum
5,082,169 A 1/1992 Aurness et al.
5,090,222 A 2/1992 Imran
5,117,661 A 6/1992 Carl et al.
5,125,248 A 6/1992 Ling
D331,908 S 12/1992 Hollander et al.
5,218,846 A 6/1993 Cook et al.
5,237,842 A 8/1993 Rasch et al.
5,327,752 A 7/1994 Myers et al.
5,381,685 A 1/1995 Carl et al.
5,400,629 A 3/1995 Myers
5,408,212 A 4/1995 Meyers et al.
5,428,369 A 6/1995 Pranger et al.
5,460,020 A 10/1995 Hungerford
5,485,734 A 1/1996 Yang
5,493,878 A 2/1996 Murray, Jr. et al.
5,502,989 A 4/1996 Murray, Jr. et al.
5,520,032 A 5/1996 Ling
5,525,964 A 6/1996 Ming
D372,187 S 7/1996 Ling
5,557,954 A 9/1996 Ling
5,574,480 A 11/1996 Pranger et al.
5,588,877 A 12/1996 Davis et al.
5,590,608 A 1/1997 Yore et al.
5,595,080 A 1/1997 Whinton
5,638,707 A 6/1997 Gould
5,642,131 A 6/1997 Pekelney et al.
5,715,709 A 2/1998 Lai
D391,833 S 3/1998 Wasson et al.
5,737,947 A 4/1998 Ling
5,746,075 A 5/1998 Yang
5,765,409 A 6/1998 Yang
5,791,172 A 8/1998 Deighton et al.
5,794,465 A 8/1998 Hill
5,794,466 A 8/1998 Hungerford et al.
D400,170 S 10/1998 Asai et al.
5,829,285 A * 11/1998 Wilson ..... 70/226
5,868,012 A 2/1999 Chun-Te et al.
5,870,914 A 2/1999 Dawson
D406,522 S 3/1999 Ling
5,881,582 A 3/1999 Monaco
5,886,644 A 3/1999 Keskin et al.
5,911,764 A 6/1999 Wei Kong
5,983,679 A 11/1999 Reyes
6,000,251 A 12/1999 Murray, Jr. et al.
6,000,252 A 12/1999 Murray, Jr. et al.
6,029,481 A 2/2000 Lai
6,035,672 A 3/2000 Lai
6,047,575 A 4/2000 Larson et al.
6,047,577 A 4/2000 Klimas
D424,016 S 5/2000 Gipson et al.
6,070,442 A 6/2000 Neeley et al.
6,112,562 A 9/2000 Murray, Jr. et al.
6,137,472 A 10/2000 Pekelney et al.
6,146,181 A 11/2000 Plaza
6,147,622 A 11/2000 Fonea
D434,966 S 12/2000 Ling
6,155,088 A 12/2000 Murray, Jr. et al.
6,164,096 A 12/2000 Lai
6,192,719 B1 2/2001 Stukas et al.
6,227,016 B1 5/2001 Yu
D444,768 S 7/2001 Kishi
D450,232 S 11/2001 Taylor et al.
D451,002 S 11/2001 Lai
6,315,485 B1 11/2001 Speck et al.
6,317,313 B1 11/2001 Mosgrove et al.
6,408,660 B1 6/2002 Lai
6,434,980 B1 8/2002 Foster
6,449,992 B1 9/2002 Yu et al.
6,474,116 B1 11/2002 Lai
6,485,086 B2 11/2002 McGrath, Jr.
6,490,893 B1 12/2002 Benion
6,494,065 B2 12/2002 Babbitt, III
6,513,356 B1 2/2003 Yang
6,516,643 B1 2/2003 Olshausen

(56) References Cited

U.S. PATENT DOCUMENTS

| | | | |
|---|---|---|---|
| D471,872 | S | 3/2003 | Kawase |
| 6,526,786 | B1 | 3/2003 | Kayoda |
| D472,877 | S | 4/2003 | Jaag |
| 6,539,761 | B2 | 4/2003 | Yang |
| 6,553,794 | B1 | 4/2003 | Murray, Jr. et al. |
| 6,553,795 | B1 | 4/2003 | Trempala |
| D474,674 | S | 5/2003 | Ling |
| 6,571,948 | B2 | 6/2003 | Jones |
| 6,575,005 | B1 | 6/2003 | Hunter |
| 6,588,241 | B1 | 7/2003 | Murray, Jr. et al. |
| 6,598,434 | B2 | 7/2003 | Yang |
| 6,615,626 | B2 | 9/2003 | Yu et al. |
| 6,619,083 | B2 | 9/2003 | Hartel et al. |
| 6,675,614 | B2 | 1/2004 | Lai |
| 6,679,088 | B2 | 1/2004 | Hartel et al. |
| D486,720 | S | 2/2004 | Ling |
| 6,708,532 | B2 | 3/2004 | Winland |
| 6,708,534 | B1 | 3/2004 | Ruan |
| 6,727,801 | B1 | 4/2004 | Gervasi et al. |
| 6,729,166 | B1 | 5/2004 | Lai |
| 6,732,664 | B2 | 5/2004 | Worrall |
| 6,735,990 | B1 | 5/2004 | Murray, Jr. et al. |
| 6,742,366 | B1 | 6/2004 | Lai |
| 6,761,051 | B1 | 7/2004 | Tsai |
| 6,792,778 | B1 | 9/2004 | Chen |
| 6,799,445 | B1 | 10/2004 | Tsai |
| 6,813,912 | B1 | 11/2004 | Ng et al. |
| 6,834,519 | B1 | 12/2004 | Yang |
| 6,843,080 | B1 | 1/2005 | Yu |
| 6,848,283 | B1 | 2/2005 | Lin |
| 6,851,213 | B1 | 2/2005 | Doiron |
| 6,860,125 | B1 | 3/2005 | Yu |
| 6,860,126 | B2 | 3/2005 | Ling |
| 6,877,345 | B1 | 4/2005 | Misner et al. |
| 6,880,370 | B2 | 4/2005 | Yu |
| 6,883,354 | B1 | 4/2005 | Yu |
| 6,883,355 | B2 | 4/2005 | Lai |
| 6,904,776 | B1 | 6/2005 | Lin |
| 6,912,879 | B1 | 7/2005 | Yu |
| 6,912,880 | B2 | 7/2005 | Ling et al. |
| 6,926,544 | B2 | 8/2005 | Lee |
| 6,928,842 | B1 | 8/2005 | Huang |
| 6,937,140 | B1 | 8/2005 | Outslay et al. |
| 6,938,445 | B2 | 9/2005 | Huang |
| 6,997,023 | B1 | 2/2006 | Huang |
| 7,003,988 | B2 | 2/2006 | Yu |
| 7,007,520 | B1 | 3/2006 | Lin |
| 7,007,521 | B1 | 3/2006 | Misner et al. |
| 7,021,092 | B2 | 4/2006 | Loughlin et al. |
| 7,021,537 | B2 | 4/2006 | Tropp |
| 7,036,728 | B2 | 5/2006 | Tropp |
| 7,047,772 | B2 | 5/2006 | Yu |
| 7,086,258 | B2 | 8/2006 | Fisher et al. |
| 7,100,401 | B2 | 9/2006 | Yu |
| 7,100,403 | B2 | 9/2006 | Murray, Jr. et al. |
| 7,100,404 | B2 | 9/2006 | Murray, Jr. et al. |
| 7,111,479 | B2 | 9/2006 | Murray, Jr. et al. |
| 7,114,356 | B1 | 10/2006 | Yu |
| 7,121,123 | B2 | 10/2006 | Yu |
| 7,121,125 | B2 | 10/2006 | Murray, Jr. et al. |
| 7,131,299 | B1 | 11/2006 | Huang |
| 7,140,209 | B2 | 11/2006 | Lai |
| 7,140,210 | B2 | 11/2006 | Cheng |
| 7,152,439 | B1 | 12/2006 | Chang |
| 7,155,943 | B1 | 1/2007 | Lin |
| 7,155,944 | B1 | 1/2007 | Lin |
| 7,159,422 | B1 | 1/2007 | Misner et al. |
| 7,174,756 | B2 | 2/2007 | Ling et al. |
| 7,193,503 | B2 | 3/2007 | Fisher |
| 7,194,879 | B2 | 3/2007 | Sedon et al. |
| 7,213,425 | B2 | 5/2007 | Ling et al. |
| 7,222,506 | B2 | 5/2007 | Yu |
| 7,251,967 | B2 | 8/2007 | Yang |
| 1,025,538 | A1 | 5/2012 | Roche |
| 2002/0088256 | A1 | 7/2002 | Taylor et al. |
| 2003/0101778 | A1 | 6/2003 | Carl et al. |
| 2004/0226324 | A1 | 11/2004 | Loughlin et al. |
| 2004/0226325 | A1 | 11/2004 | Ling |
| 2004/0246096 | A1 | 12/2004 | Queenan |
| 2004/0255624 | A1 | 12/2004 | Loughlin et al. |
| 2005/0034492 | A1 | 2/2005 | Yu |
| 2005/0039500 | A1 | 2/2005 | Yu |
| 2005/0039501 | A1 | 2/2005 | Yu |
| 2005/0044901 | A1 | 3/2005 | Yu |
| 2005/0044903 | A1 | 3/2005 | Ling et al. |
| 2005/0150263 | A1 | 7/2005 | Murray, Jr. et al. |
| 2005/0154605 | A1 | 7/2005 | Tropp |
| 2005/0155397 | A1 | 7/2005 | Yu |
| 2005/0210932 | A1 | 9/2005 | Azzalin et al. |
| 2005/0223758 | A1 | 10/2005 | Yu |
| 2005/0229655 | A1 | 10/2005 | Yu |
| 2005/0235705 | A1 | 10/2005 | Ling |
| 2005/0235706 | A1 | 10/2005 | Ling |
| 2005/0262902 | A1 | 12/2005 | Ling |
| 2005/0262903 | A1 | 12/2005 | Ling |
| 2006/0032274 | A1 | 2/2006 | Yu |
| 2006/0107708 | A1 | 5/2006 | Yu |
| 2006/0107709 | A1 | 5/2006 | Yu |
| 2006/0130540 | A1 | 6/2006 | Lin |
| 2006/0179899 | A1 | 8/2006 | Yu |
| 2006/0218981 | A1 | 10/2006 | Yu |
| 2006/0225469 | A1 | 10/2006 | Yu |
| 2006/0236731 | A1 | 10/2006 | Yu |
| 2006/0260369 | A1 | 11/2006 | Lai et al. |

FOREIGN PATENT DOCUMENTS

| | | |
|---|---|---|
| DE | 18176 | 12/1882 |
| DE | 41200 | 10/1887 |
| DE | 277587 | 8/1914 |
| DE | 509775 | 10/1930 |
| DE | 1553419 | 7/1970 |
| DE | 4140137 | 6/1993 |
| DE | 9319327 | 2/1994 |
| DE | 29611064 | 3/1998 |
| DE | 29814068 | 11/1998 |
| DE | 29823528 | 7/1999 |
| DE | 19937845 | 2/2001 |
| DE | 10049638 | 4/2002 |
| DE | 10122518 | 11/2002 |
| EP | 216823 | 4/1989 |
| EP | 1371797 | 12/2003 |
| GB | 588930 | 6/1947 |
| GB | 2191534 | 12/1987 |
| GB | 2312468 | 10/1997 |
| JP | 31007 | 4/1917 |
| JP | 6-3441 | 3/1931 |
| JP | 50-26793 | 3/1975 |
| JP | 55-78769 | 6/1980 |
| JP | 60-97862 | 7/1985 |
| JP | 7-217293 | 8/1995 |
| JP | 7-217294 | 8/1995 |
| TW | 195339 | 11/1992 |
| TW | 366943 | 8/1999 |
| TW | 482222 | 4/2002 |
| TW | 092208756 | 5/2003 |
| TW | 575046 | 2/2004 |
| TW | M247654 | 10/2004 |
| TW | M280402 | 11/2005 |
| WO | WO 2005/047626 | 5/2005 |

OTHER PUBLICATIONS

Columbia Sportswear Company, "Adventure Gear" Fall 2003/Spring 2004 Catalog, copyright 2002, printed in the United States Nov. 2002, 4 pages.

"Columbia Lock" model No. C3440, shown in Columbia Sportswear Company, "Adventure Gear" Fall 2003/Spring 2004 Catalog, 3 pages.

"Columbia Lock" model No. C3442, shown in Columbia Sportswear Company, "Adventure Gear" Fall 2003/Spring 2004 Catalog, 3 pages.

(56) References Cited

OTHER PUBLICATIONS

"Introduction to Travel Sentry", Travel Goods Show, Las Vegas, Mar. 27, 2003, 11 pages.

Horowitz, "Facsimile Transmittal to Central Scanning, including Declaration of David Tropp in connection with U.S. Appl. No. 10/706,500", transmission dated Oct. 12, 2005, 15 pages.

"01844/5 Instructions" Blue Moon, date unknown, 1 page.

"Combination Lock", available at http://buy-bags-online.efastmall.com/17330.htm, printed Mar. 1, 2005; 1 page.

"Deluxe Vault Duo", available at http://buy-bags-online,efastmall.com/17340.htm, printed Mar. 1, 2005; 1 page.

"GE Security Access Point Stor-A-Key", General Electric Company 2004, 2 pages.

"Improving the Way Agents Sell Real Estate" GE Interlogix Supra, 2002, 7 pages.

"KeySafe Original" GE Infrastructure Security, available at http://www.geindustrial.com/ge-interlogix/solutions/consumer/keysafe_permanent.htm, printed Jan. 4, 2007, 2 pages.

"Locking Stor-A-Key" GE Infrastructure Security, available at http://www.geindustrial.com/ge-interlogix/solutions/consumer/storakey_locking.htm, printed Jan. 4, 2007, 1 page.

"Portable Stor-A-Key" GE Infrastructure Security, available at http://www.geindustrial.com/ge-interlogix/solutions/consumer/storakey_portable.htm, printed Jan. 4, 2007, 1 page.

* cited by examiner

PADLOCK

CROSS-REFERENCE TO RELATED APPLICATIONS

This is a continuation patent application which claims priority from U.S. Utility patent application Ser. No. 10/759,413, entitled "PADLOCK," filed on Jan. 16, 2004, and now issued on Feb. 13, 2007, as U.S. Pat. No. 7,174,756, which in turn claims foreign priority from Taiwanese (ROC) Patent Application No. 092208756, filed May 14, 2003, both of which are herein incorporated by reference in their entirety.

BACKGROUND OF THE INVENTION

1. Field of the Invention

The present invention generally relates to a padlock, particularly to a dual-operational padlock which can be operated by either a key or a combination.

2. Description of the Related Art

A padlock is a well known product and is applicable to a variety of articles which may be under an obvious or potential safety risk, to prevent them from being opened. For example, to prevent an unintended user from opening a luggage, a padlock can be used to lock the overlapped pull tabs of the zipper of the luggage such that the zipper cannot be separated.

Generally, based on the locking mechanism utilized, conventional padlocks can be divided into two groups, key-operated padlocks and combination-operated padlocks. These two groups of padlocks have their respective advantages: namely, the key-operated padlock avoids the risk that a combination is forgotten; and the combination-operated padlock does not need a key and thus avoids the risk of losing it.

Yang's U.S. Pat. No. 6,539,761, discloses a padlock combining the functions of a key padlock and a combination padlock. A user thus is able to use either a key or a combination to unlock the padlock. In this case, both locking operations are performed to lock a shackle, and both ends of the shackle are extended into a casing of the padlock and restricted therein. Accordingly, when the padlock is in a locked state, the article hooked by the shackle and restricted by the casing and the shackle cannot be taken off; and when the padlock is in an unlocked state, the shackle axially moves with respect to the casing, and one end of the shackle separates from the casing to form an opening to release the hooked article.

According to the disclosure of U.S. Pat. No. 6,539,761 as well as the related prior art, to lock the shackle, the shackle generally has a notch formed thereon for engaging with the locking mechanism associated with the shackle; that is, the notch plays a key role in letting the locking mechanism lock the shackle. The disadvantages resulted therefrom are that the forming of the notch on the shackle needs more machining processes and decreases the structure strength of the shackle.

BRIEF SUMMARY OF THE INVENTION

A main objective of the present invention is to provide a padlock which can be operated by either a key or a combination.

A further objective of the present invention is to provide a padlock which can lock the shackle without the requirement of a notch.

To achieve the above objective, the padlock in accordance with the present invention comprises: a casing; a shackle having a free first end and a second end, the second end being pivotally connected to the casing; a locking mechanism received within the casing and limiting the axial movement of the second end of the shackle; a latching tube received and operative to be moved within the casing; and a stop member driven by the latching tube so as to be moved between a first position where the first end of the shackle can be rotated by using the second end thereof as a center of rotation, and a second position where the stop member prevents the first end of the shackle from moving, and the shackle and the casing co-define a closed loop.

Other and further features, advantages and benefits of the invention will become apparent in the following description taken in conjunction with the following drawings. It is to be understood that the foregoing general description and following detailed description are exemplary and explanatory but are not to be restrictive of the invention. The accompanying drawings are incorporated in and constitute a part of this application and, together with the description, serve to explain the principles of the invention in general terms. Like numerals refer to like parts throughout the disclosure.

BRIEF DESCRIPTION OF THE DRAWINGS

The objectives, spirits and advantages of the preferred embodiments of the present invention will be readily understood by persons skilled in the art from the accompanying drawings and detailed descriptions, wherein.

DETAILED DESCRIPTION OF THE INVENTION

Figure 1:
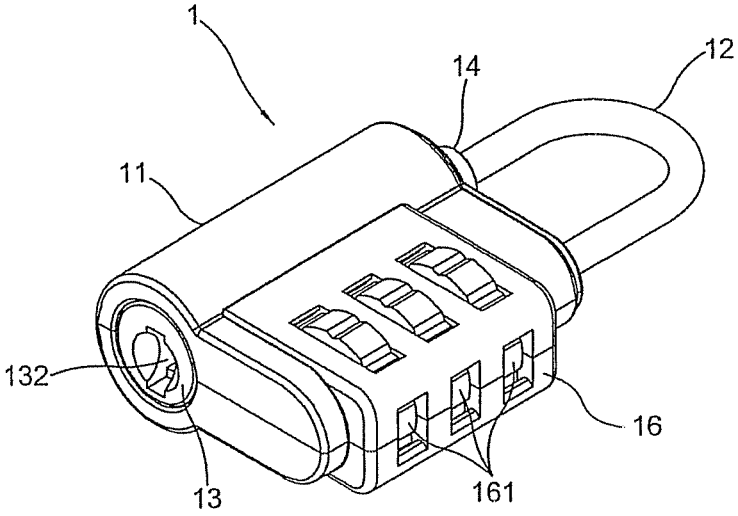
FIG. 1 is a perspective view of a padlock in accordance with a first preferred embodiment of the present invention.
Figure 2:
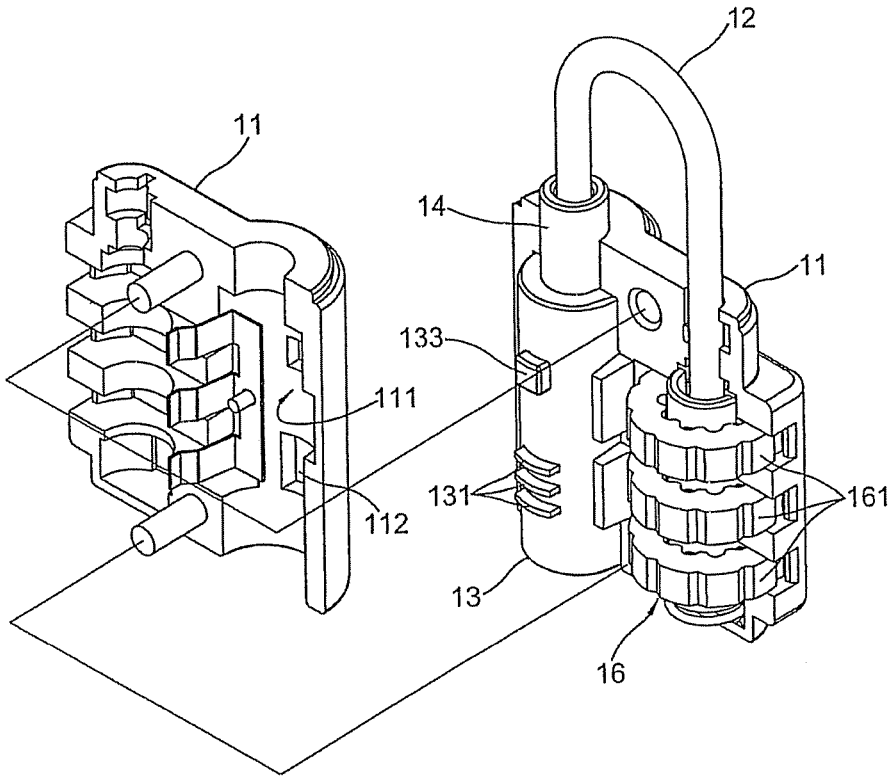
FIG. 2 is a partially exploded view of the padlock in accordance with the first preferred embodiment of the present invention.

As shown in FIGS. 1 and 2, a padlock 1 in accordance with the first preferred embodiment substantially comprises a casing 11, a shackle 12, a latching tube 13, a stop member 14 and a locking mechanism 16.

The shackle 12 is in the shape of a U-shaped bar and has a free first end 121 and a second end 122 which is pivotally connected to the casing 11.

Figure 3A:
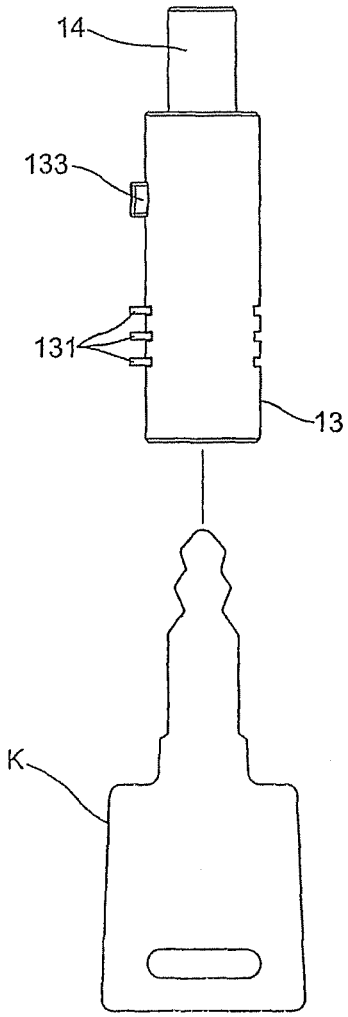
FIG. 3A and FIG. 3B are schematic views showing the operations of the latching tube shown in FIG. 1 by inserting a key thereinto.
Figure 3B:
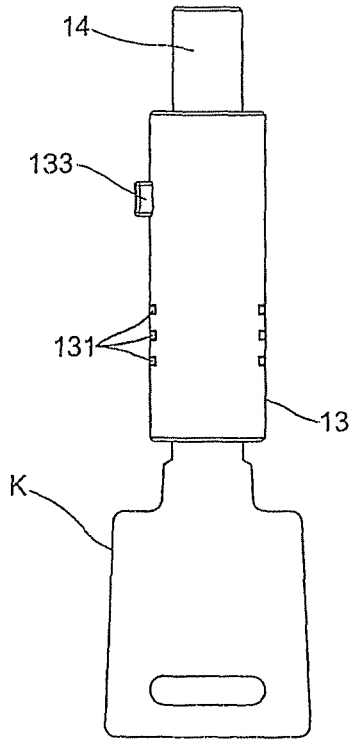

The latching tube 13 is disposed within the casing 11. In the current embodiment, the latching tube 13 is a disc tumbler cylinder, but can also be a pin tumbler cylinder or other mechanisms performing the similar functions. Further, as shown in FIGS. 3A and 3B, the latching tube 13 is provided with a plurality of disks 131, a key hole 132 and a block 133. The disks 131 are received within the tube body with the peripheral edges thereof retractably extending from the circumferential surface of the tube body. The block 133 is mounted on the circumferential surface of the tube body and is located above the disks 131. In addition, the key hole 132 is provided on the bottom of the tube body for controlling the movements of the disks 131 in a way that when a key K is inserted into the key hole 132, the peripheral edges of the disks 131 are retracted to be received within the latching tube 13 (see FIG. 3A); and when the key K is withdrawn from the key hole 132, the peripheral edges of the disks 131 extend out of the circumferential surface of the latching tube 13 (see FIG. 3B). Since the latching tube 13 is a conventional member, the detailed structure thereof is not further discussed hereinafter.

Figure 4:
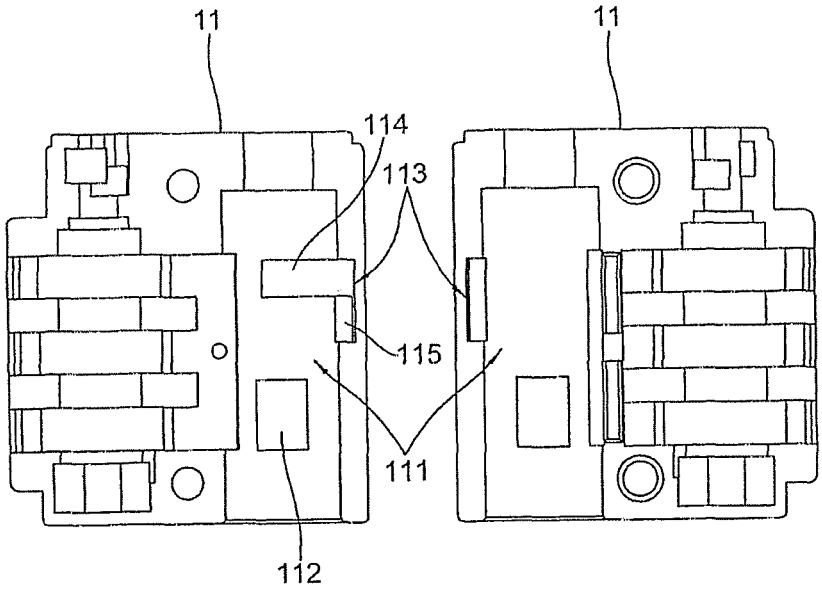
FIG. 4 is a schematic view showing both parts of the casing of the padlock in accordance with the first preferred embodiment of the present invention.
Figure 5:
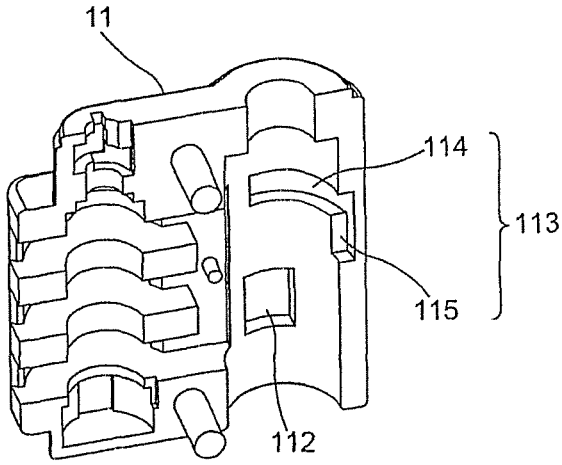
FIG. 5 is a perspective view showing a part of the casing of the padlock in accordance with the first preferred embodiment of the present invention.
Figure 6:
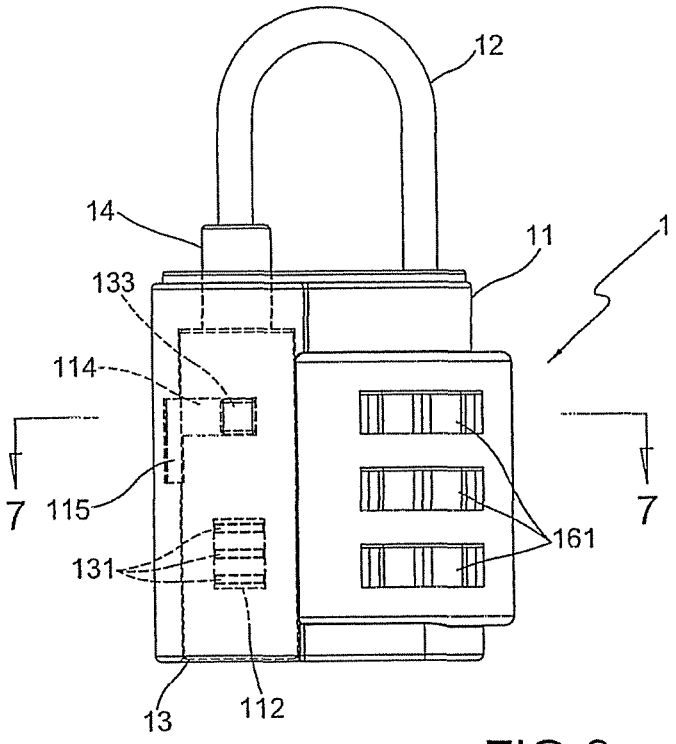
FIG. 6 is a front view of the padlock in accordance with the first preferred embodiment of the present invention.
Figure 7:
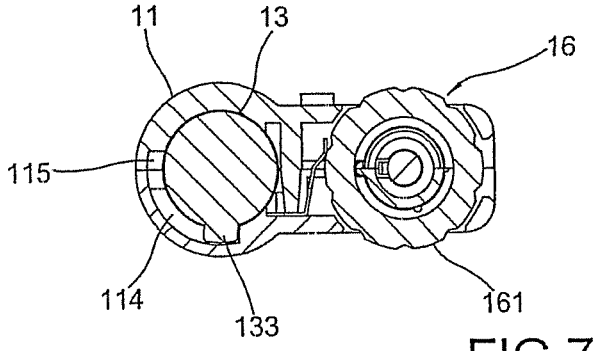
FIG. 7 is a sectional view taken alone Line 7-7 in FIG. 6.

As shown in FIGS. 2, 4 and 5, the interior of the casing 11 defines a chamber 111 for receiving the latching tube 13 therein. The inner wall of the casing 11, which surrounds the chamber 111, is formed with a substantially L-shaped slot 113 and a recess 112 below the L-shaped slot 113. In addition, as shown in FIGS. 6 and 7, the L-shaped slot 113 includes a transverse slot 114 and a longitudinal slot 115 to receive and restrict the block 133 of the latching tube 13 such that it can only move along the L-shaped slot 113. The recess 112 is used to receive the peripheral edges of the disks 131 when they extend from the tube body of the latching tube 13, so as to position the latching tube 13. In other words, when the peripheral edges of the disks 131 are retracted to be received within the latching tube 13, the latching tube 13 disengages with the recess 112 of the casing 11 and the block 133 of the latching tube 13 is allowed to move along the transverse slot 114 and the longitudinal slot 115.

The stop member 14 is disposed on the top of the latching tube 13. In the current embodiment, it is fommed integrally with the latching tube 13 but can also be separate from and be driven by the latching tube 13 in accordance with the other embodiments that will be described later. As shown in FIGS. 2, 3A and 3B, the stop member 14 is in the shape of a cylindrical body with the top thereof formed with a hole 141 for receiving the first end 121 of the shackle 12.

Figure 11A:
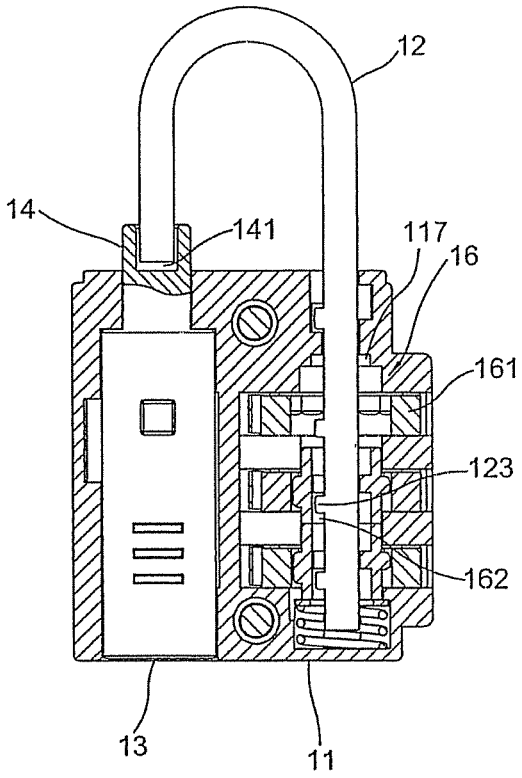
FIGS. 11A and 11B are schematic views showing the operations of the padlock in accordance with the first preferred embodiment of the present invention, wherein the dials of the combination locking mechanism are adjusted so as to unlock the first end of the shackle.
Figure 11B:
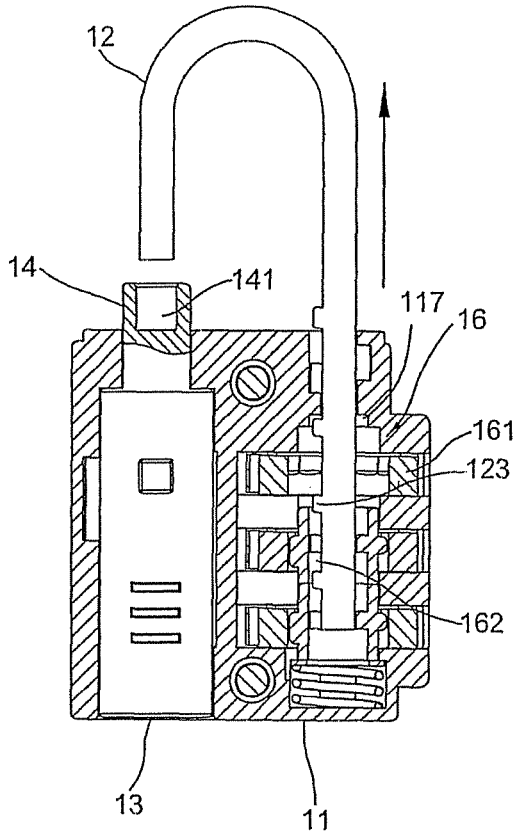

The locking mechanism 16 is a conventional combination locking mechanism and is used to limit the axial movement of the second end 122 of the shackle 12 (see FIG. 2). As shown in FIGS. 11A and 11B, the locking mechanism 16 is received in the casing 11, at the side opposite to the latching tube 13, and comprises a plurality of hollow dials 161 with each having an axial groove 162 formed on the inner wall thereof. The second end 122 of the shackle 12 passes through the dials 161 and has a row of axial teeth 123 formed thereon. Each tooth 123 corresponds to an axial groove 162 of the dial 161 such that unless all axial grooves 162 of the dials 161 are rotated to align with the axial teeth 123, the axial movement of the second end 122 of the shackle 12 will be confined by the dials 161. Further, to avoid the condition that when all axial grooves 162 of the dials 161 align with the axial teeth 123, the entire shackle 12 falls out of the casing 11, a neck portion 117 is formed within the casing 11 such that the second end 122 of the shackle 12 can axially move for a certain distance which should be large enough for releasing the first end 121 of the shackle 12 from the stop member 14.

Based on the above structures, the padlock 1 in accordance with the first preferred embodiment of the present invention is constructed (see FIGS. 6 and 7).

The operation of the padlock 1 by means of a key K is described with reference to FIGS. 6, 7, 8A to 8C, wherein the locking mechanism 16 is adjusted to limit the axial movement of the second end 122 of the shackle 12. As shown in FIGS. 6 and 7, when the padlock 1 is in a locked state, where the latching tube 13 is at a second position and the shackle 12 and the casing 11 co-define a closed loop, the block 133 of the latching tube 13 is located at a first end of the transverse slot 114, the peripheral edges of the disks 131 engage with the recess 112, and the first end 121 of the shackle 12 is received within the hole 141 formed on the stop member 14.

Figure 8A:
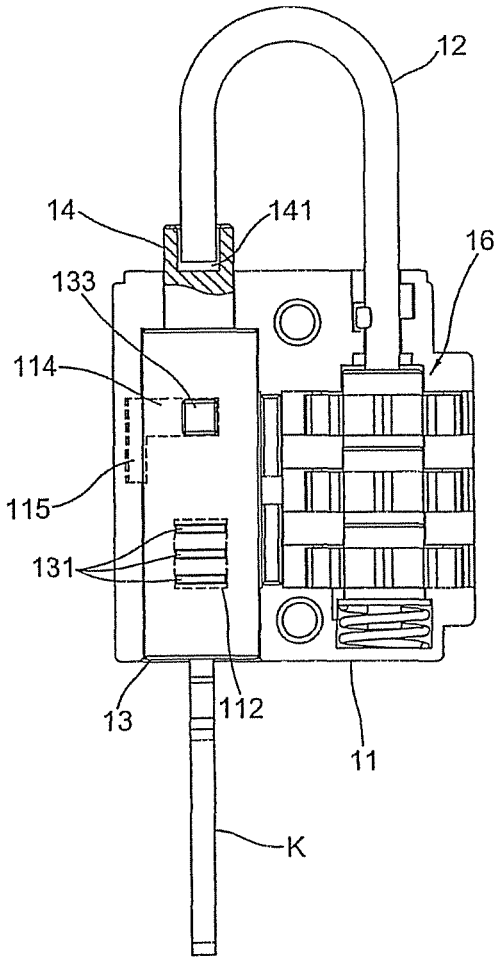
FIGS. 8A to 8C are schematic views showing the operations of the padlock in accordance with the first preferred embodiment of the present invention, wherein a key is inserted into the latching tube so as to move the latching tube between a first position and a second position to unlock and lock the first end of the shackle.
Figure 8B:
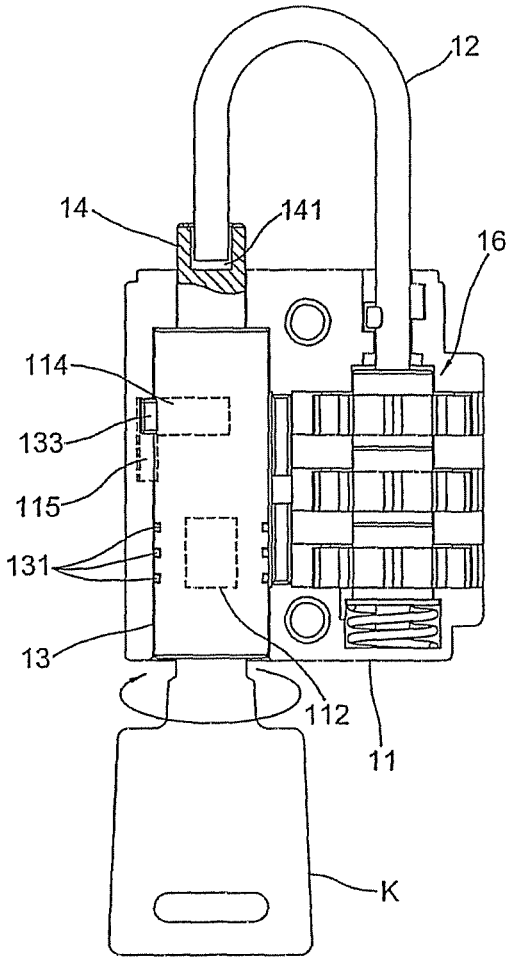
Figure 8C:
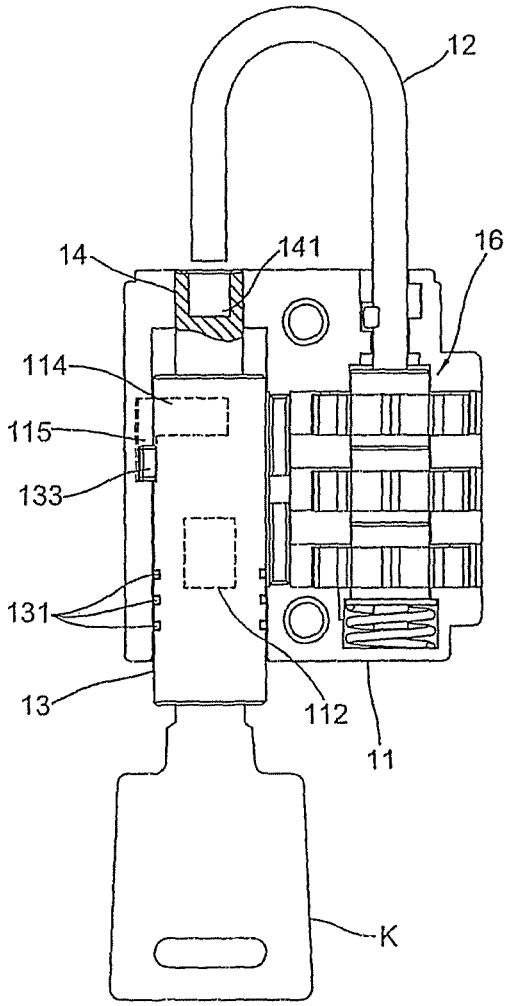

By inserting the key K into the key hole 132 of the latching tube 13, the peripheral edges of the disks 131 are retracted to be received within the latching tube 13 and are disengaged with the recess 112 of the casing 11 (see FIG. 8A). Next, the key K is turned clockwise to move the block 133 to a second end of the transverse slot 114, namely, the intersection between the transverse slot 114 and the longitudinal slot 115 (see FIG. 8B). Last, the key K is pulled downward to move the latching tube 13 to the lower end of the longitudinal slot 115, wherein the latching tube 13 is moved to a first position, the stop member 14, associated with the latching tube 13, is separate from the first end 121 of the shackle 12, and the padlock 1 is in an unlocked state (see FIG. 8C).

Figure 9:
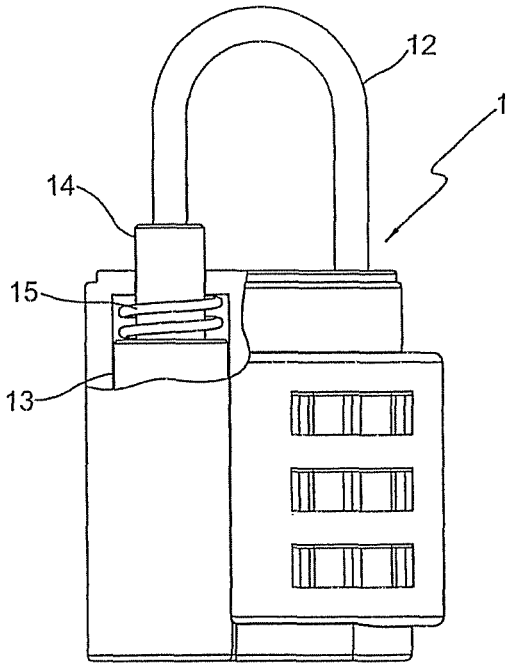
FIG. 9 is a partially sectional view of the padlock in accordance with the first preferred embodiment of the present invention, wherein an elastic element is optionally provided for biasing the latching tube toward the first position.

In addition, as shown in FIG. 9, to facilitate the downward movement of the latching tube 13 toward the first position, an elastic element, e.g., a spring 15, is provided within the casing 11, between the inner upper wall of the casing 11 and the top of the latching tube 13 to bias the latching tube 13 downward.

Figure 10:
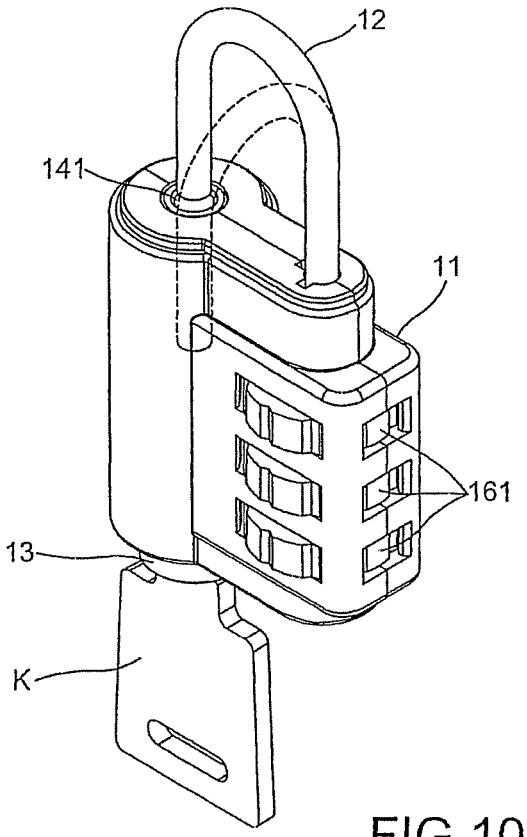
FIG. 10 is a perspective view of the padlock in accordance with the first preferred embodiment of the present invention, showing the pivotal movement of the first end of the shackle unlocked by using a key.

FIG. 10 shows a perspective view of the padlock 1 unlocked by the key K. Since the axial movement of the second end 122 of the shackle 12 is limited, the first end 121 of the shackle 12 can only be rotated by using the second end 122 thereof as a center of rotation and an opening is thus formed between the shackle 12 and the casing 11 so as to hook the desired portions of the article to be locked.

To move the padlock 1 back to the locked state, the user first rotates the first end 121 of the shackle 12 to align with the stop member 14. Further, the key K is pushed upward to move the latching tube 13 upward, until the block 133 of the latching tube 13 presses against the upper end of the longitudinal slot 115, namely, the intersection between the transverse slot 114 and the longitudinal slot 115. At this moment, the hole 141 of the stop member 14 engages with the first end 121 of the shackle 12. The key K is then turned counterclockwise to move the block 133 of the latching tube 13 until it reaches the first end of the transverse slot 114. Last, the key is withdrawn from the key hole 132 of the latching tube 13 and the peripheral edges of the disks 131 extend out of the circumferential surface of the latching tube 13 to engage with the recess 112 of the casing 11. Accordingly, the latching tube 13 is moved back to the second position and the padlock 1 is again in a locked state.

The operation of the padlock 1 by means of a combination is described with reference to FIGS. 11A and 11B. As shown in FIG. 11A, when the padlock 1 is in a locked state, the hole 141 of the stop member 14 engages with the first end 121 of the shackle 12, the axial movement of the second end 122 of the shackle 12 is limited by the locking mechanism 16, and the shackle 12 and the casing 11 co-define a closed loop.

As shown in FIG. 4B, by adjusting the dials 161 of the locking mechanism 16 to align the axial teeth 123 formed along the second end 122 of the shackle 12 with the axial grooves 162 of the dials 161, the second end 122 of the shackle 12 can be moved axially until the first end 121 of the shackle 12 is separate from the stop member 14. Accordingly, the padlock 1 is in an unlocked state.

Figure 12:
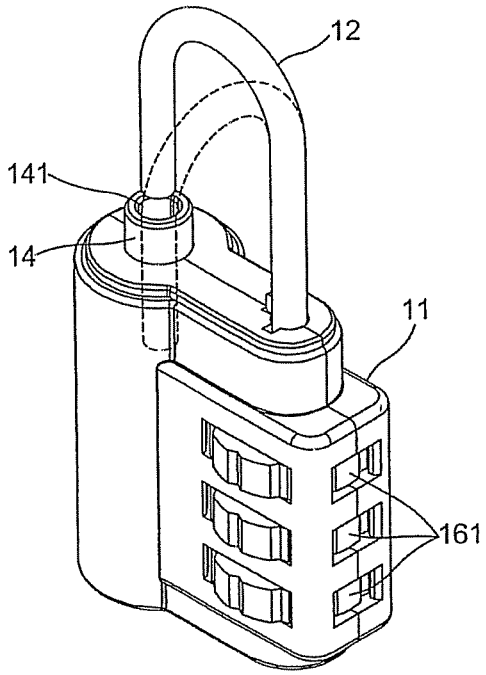
FIG. 12 is a perspective view of the padlock in accordance with the first preferred embodiment of the present invention, showing the pivotal movement of the first end of the shackle unlocked by operating the combination locking mechanism.

FIG. 12 shows a perspective view of the padlock 1 unlocked by the combination, wherein the first end 121 of the shackle 12 can be rotated by using the second end 122 thereof as a center of rotation and an opening is thus formed between the shackle 12 and the casing 11 so as to hook the desired portions of the article to be locked.

To move the padlock 1 back to the locked state, the user first rotates the first end 121 of the shackle 12 to engage it with the hole 141 of the stop member 14 and the axial teeth 123 of the second end 122 of the shackle 12 simultaneously pass through the axial grooves 162 of the dials 161. By adjusting the dials 161, the axial teeth 123 are not allowed to pass through the axial grooves 162 and the padlock 1 is again in a locked state.

Based on the above descriptions, the padlock in accordance with the first preferred embodiment of the present invention is disclosed. It can be operated by either a key or a combination. In addition, it can be observed that the stop member 14 and the locking member 16 respectively limits the rotational movement of the first end 121 of the shackle 12 and the axial movement of the second end 122 of the shackle 12 to perform the desired locking function. Further, since there is no notch formed on the shackle 12, the cost for the additional machining process can be avoided and the structure strength of the shackle is superior to that of the conventional shackle.

Figure 13:
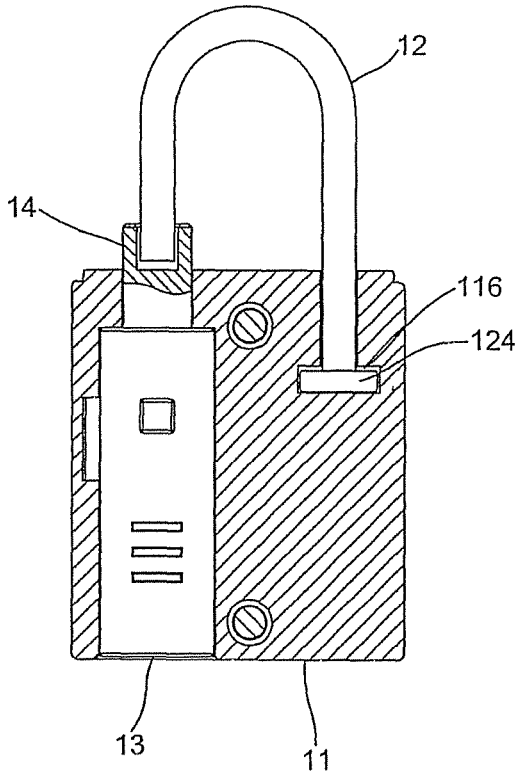
FIG. 13 is a partially sectional view of a padlock in accordance with a second preferred embodiment of the present invention.

FIG. 13 shows a partially sectional view of a padlock in accordance with a second embodiment of the present invention. In the current embodiment, a hole 116 is formed within the casing 11'. In addition, the locking mechanism 16' comprises a shoulder 124 which protrudes from the second end 122 of the shackle 12 and is pivotally received within the hole 116 of the casing 11' such that the axial movement of the second end 122 of the shackle 12 is limited. However, since there is no combination locking mechanism provided, the padlock in the current embodiment can only function as a key-operated padlock.

Nevertheless, by installing the combinational locking mechanism disclosed in the first preferred embodiment into the casing of a currently existing key-operated padlock or the padlock disclosed in the second preferred embodiment disclosed above, it can be modified into a dual-operational padlock.

The following descriptions will focus on different arrangements among the first end of the shackle, the stop member and the latching tube of the padlocks in accordance with the different embodiments of the present invention. For the purpose of simplification, an element performing the same function as that does in the first preferred embodiment is denoted by the same reference numeral as that denoted in the first preferred embodiment.

Figure 14A:
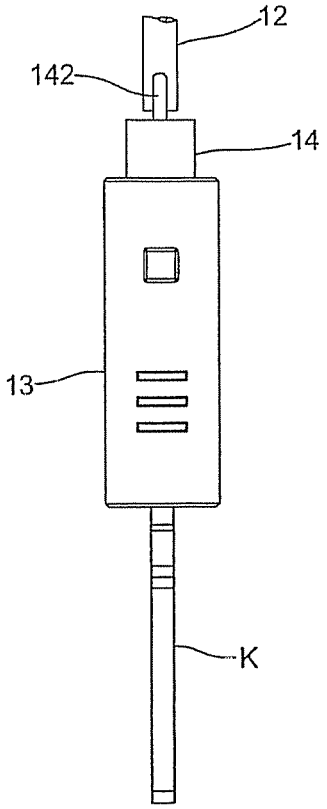
FIGS. 14A and 14B are schematic views showing the operations of a padlock in accordance with a third preferred embodiment of the present invention, wherein a key is inserted into the latching tube so as to move the latching tube between a first position and a second position to unlock and lock the shackle.
Figure 14B:
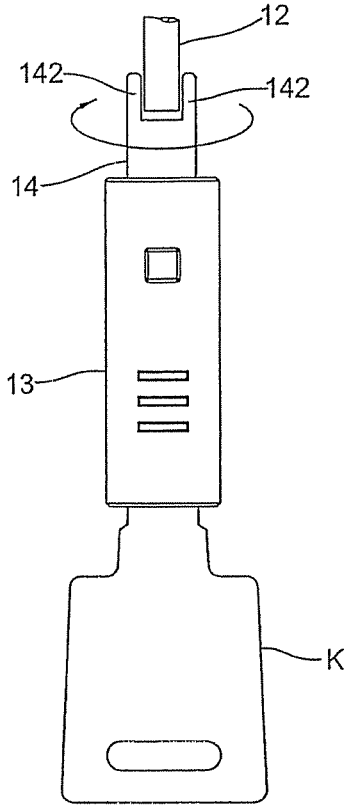
Figure 15:
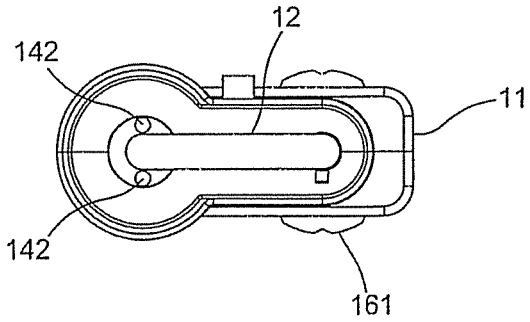
FIG. 15 is a top plan view of the padlock in accordance with the third preferred embodiment of the present invention.

FIGS. 14A and 14B disclose different spatial relationships among a first end 121 of the shackle 12, a stop member 14 and a latching tube 13 for a padlock 1 in accordance with a third preferred embodiment of the present invention. FIG. 15 is further directed to the top view of the padlock 1.

As shown in FIGS. 14A, 14B and 15, in the current embodiment, instead of a hole formed within the stop member 14, the top of the stop member 14 and the top of the casing 11 are in the same plane, and two opposite stop blocks or arms 142 are protruded upward from the top of the stop member 14 with a space formed between arms 142. When the padlock 1 is at the unlocked state, the latching tube 13 is at a first position (see FIG. 14B) and the first end 121 of the shackle 12 can pass through the space between two arms 142 and can be freely rotated. When the key K is turned 90.degree. clockwise to turn the latching tube 13 to a second position, the stop member 14 rotates together with the rotation of the latching tube 13 such that the arms 142 are located on the path of rotation and secure the first end 121 of the shackle 12 (see FIGS. 14A and 15) therebetween. The padlock 1 is thus in a locked state.

In addition, according to the disclosure of the present invention, there is no longitudinal slot required, since the movement of the block 133 along the transverse slot 114 can achieve the desired locking and unlocking operations for the padlock 1.

Figure 16A:
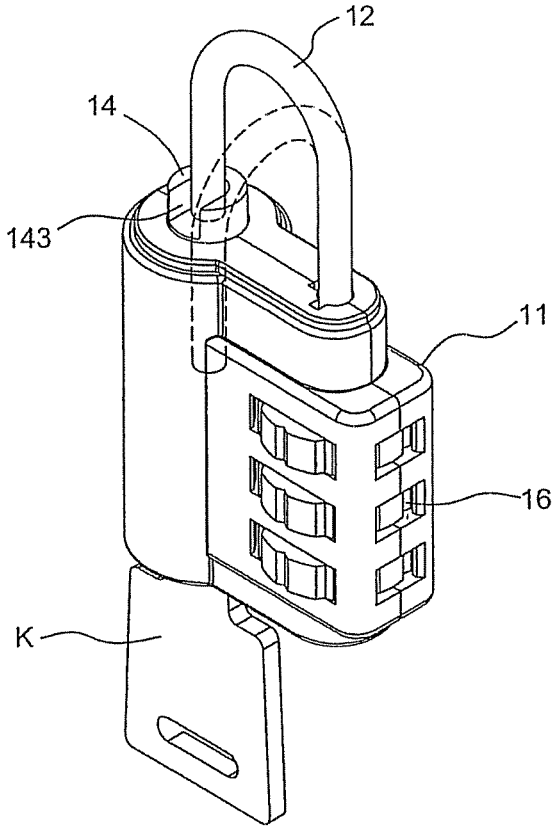
FIGS. 16A and 16B are perspective views showing the operations of a padlock in accordance with a fourth preferred embodiment of the present invention, wherein a key is inserted into the latching tube so as to move the latching tube between a first position and a second position to unlock and lock the shackle.
Figure 16B:
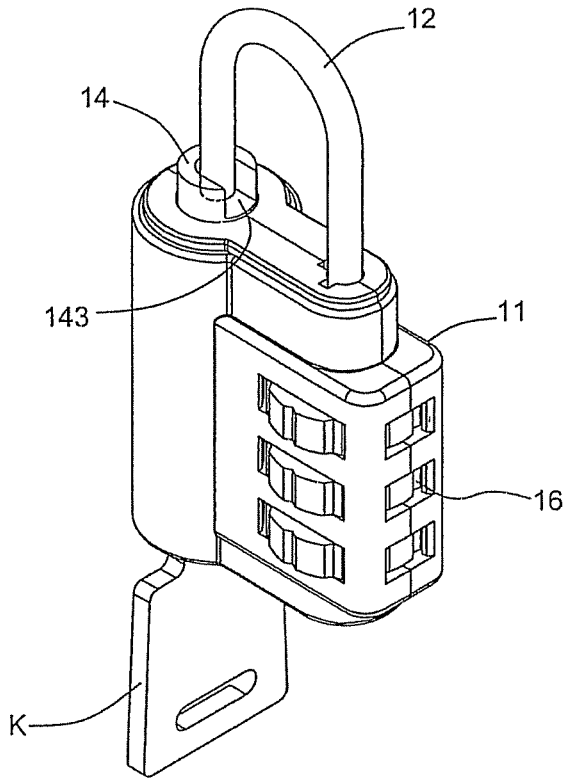

FIGS. 16A and 16B disclose different spatial relationships among a first end 121 of the shackle 12, a stop member 14 and a latching tube 13 for a padlock 1 in accordance with a fourth preferred embodiment of the present invention.

The structure and operation of the padlock 1 according to the current embodiment are substantially the same as those of the padlock shown in FIGS. 14A, 14B and 15, except that the top of the stop member 14 is modified to be a cylindrical body formed with a groove 143 which opens to the periphery of the cylindrical body and defines a bottom aligned with the top of the casing 11.

When the padlock 1 is at the unlocked state, the latching tube 13 is at a first position (see FIG. 16A) and the first end 121 of the shackle 12 can be freely rotated into and out of the groove 143. When the key K is turned 90.degree. clockwise to turn the latching tube 13 to a second position, the stop member 14 rotates together with the rotation of the latching tube 13 such that the groove 143 is oriented 90.degree. to limit the movement of the first end 121 of the shackle 12 (see FIG. 16B). The padlock 1 is thus in a locked state.

Figure 17A:
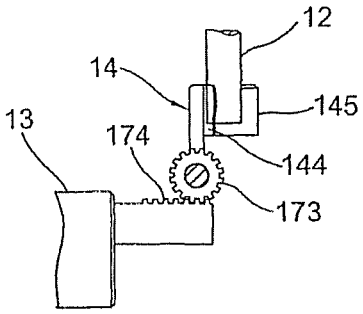
FIGS. 17A and 17B are schematic views showing the operations of a padlock in accordance with a fifth preferred embodiment of the present invention, wherein the latching tube is moved between a first position and a second position to unlock and lock the shackle.
Figure 17B:
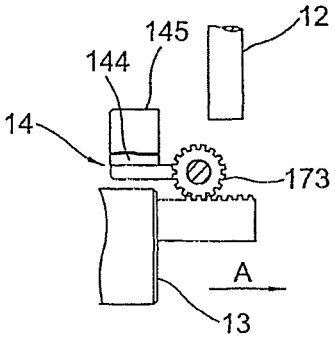

FIGS. 17A and 17B disclose a spatial relationship among a first end 121 of the shackle 12, a stop member 14 and a latching tube 13 for a padlock 1 in accordance with a fifth preferred embodiment of the present invention.

In the current embodiment, the stop member 14 is indirectly driven by the latching tube 13 by mean of teeth engagement therebetween. As shown in FIG. 17A, the stop member 14 comprises a gear 173 with a bar 144 laterally attached to the center of the gear 173 at an end thereof. The other end of the bar 144 is provided with a stop plate 145 for holding the first end 121 of the shackle 12 (see FIG. 17A), wherein the latching tube 13 is at a second position and the padlock is in a locked state.

Moreover, the latching tube 13 is oriented to be movable horizontally. A toothed rack 174 further extends from the top of the latching tube 13 and engages with the teeth of the gear 173. As the latching tube 13 moves in a direction denoted by Arrow A to a first position, the toothed rack 174 drives the gear 173 to rotate counterclockwise such that the bar 144 is also rotated counterclockwise and the stop plate 145 releases the first end 121 of the shackle 12 (see FIG. 17B). In this position, the padlock 1 is in an unlocked state.

Figure 18A:
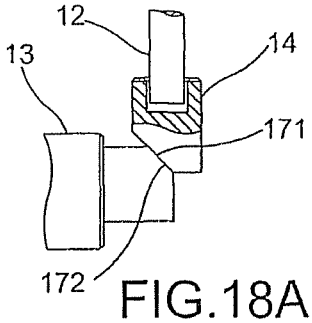
FIGS. 18A to 18B are schematic views showing the operations of a padlock in accordance with a sixth preferred embodiment of the present invention, wherein the latching tube is moved between a first position and a second position to unlock and lock the shackle.
Figure 18B:
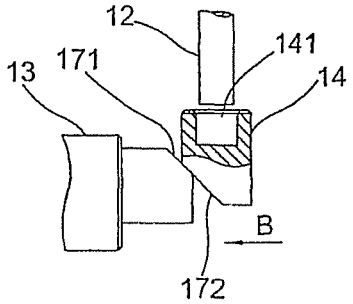

FIGS. 18A and 18B disclose a spatial relationship among a first end 121 of the shackle 12, a stop member 14 and a latching tube 13 for a padlock 1 in accordance with a sixth preferred embodiment of the present invention.

In the current embodiment, the stop member 14 is directly driven by the latching tube 13 by means of their respective inclined surfaces. As shown in FIG. 18A, a corner of the top of the latching tube 13 is formed with an inclined surface 171. Further, a corner of the bottom of the stop member 14 is formed with an inclined surface 172 corresponding to the inclined surface 171 and the top of the stop member 14 is also formed with a hole 141 for holding the first end 121 of the shackle 12. FIG. 18A shows the latching tube 13 in a second position and the padlock 1 is in a locked state.

The latching tube 13 is oriented to be movable horizontally. As the latching tube 13 moves in a direction denoted by Arrow B toward a first position, the stop member 14 moves downward with the inclined surface 172 thereof sliding along the inclined surface 171 of the latching tube 13. When the latching tube 13 moves to the first position, the stop member 14 releases the first end 121 of the shackle 12 and the padlock 1 is in an unlocked state.

Figure 19A:
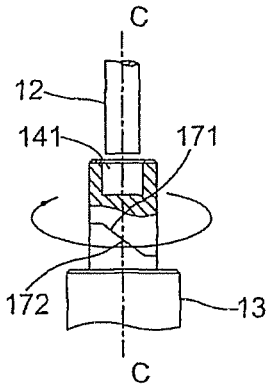
FIGS. 19A to 19B are schematic views showing the operations of a padlock in accordance with a seventh preferred embodiment of the present invention, wherein the latching tube is moved between a first position and a second position to unlock and lock the shackle.
Figure 19B:
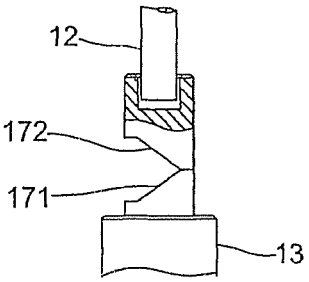

FIGS. 19A and 19B disclose a spatial relationship among a first end 121 of the shackle 12, a stop member 14 and a latching tube 13 for a padlock 1 in accordance with a seventh preferred embodiment of the present invention.

In the current embodiment, the stop member 14 is also directly driven by the latching tube 13 by means of their respective inclined surfaces. As shown in FIG. 19A, the top of the latching tube 13 is formed with an inclined surface 171. Further, the bottom of the stop member 14 is formed with an inclined surface 172 corresponding to the inclined surface 171 and the top of the stop member 14 is also formed with a hole 141 for holding the first end 121 of the shackle 12. FIG. 19A shows the latching tube 13 in a first position and the padlock 1 is in an unlocked state.

The latching tube 13 is rotatable along a vertical axis of rotation C. As the latching tube 13 rotates 180.degree. to a second position, the inclined surface 171 of the latching tube 13 pushes the inclined surface 172 of the stop member 14 to move upward such that the first end 121 of the shackle 12 is held by the hole of the stop member 14 and the padlock 1 is in a locked state.

In conclusion, the present invention provides a padlock having a shackle without a notch, and a padlock is able to position the shackle. Further, the current existing key-operated padlock in the market can be applicable to the present invention to become a dual-operational padlock.

Although this invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. A multiple function lock comprising:

a body;

a U-shaped shackle having toe and heel portions, said heel portion rotatably secured within said body;

a combination locking mechanism for securing said heel portion, said combination locking mechanism having a locked position in which said heel portion is retained within said body but is free to rotate and an unlocked position in which said heel portion may be lifted from within said body;

a second locking mechanism comprising a keyed cylinder operationally engaged with a retaining cup, said keyed cylinder having a locked position in which said retaining cup retains said toe portion therein and an unlocked position in which said retaining cup does not retain said toe portion therein;

wherein said second locking mechanism protrudes from a top side of said body in said locked position of said second locking mechanism and a bottom side of said body in said unlocked position of said second locking mechanism.

2. The multiple function lock of claim 1, wherein the operation of the combination locking mechanism is independent of the operation of the second locking mechanism.

3. The multiple function lock of claim 1, wherein said retaining cup comprises a recess for receiving said toe portion.

4. The multiple function lock of claim 1, further comprising a biasing member to bias the position of said retaining cup to a position protruding from the top side of said body.

5. The multiple function lock of claim 1, wherein said second locking mechanism comprises a disc tumbler cylinder.

6. The multiple function lock of claim 1, wherein said second locking mechanism comprises a pin tumbler cylinder.

7. The multiple function lock of claim 1, wherein said retaining cup and keyed cylinder are integrally formed.

8. The multiple function lock of claim 1, wherein said retaining cup and keyed cylinder are separate pieces.

9. The multiple function lock of claim 1, wherein said keyed cylinder comprises an outwardly extending protrusion, and said body comprises a slot in which said protrusion moves when said keyed cylinder changes between the locked position and the unlocked position.

10. The multiple function lock of claim 1, wherein said body comprises first and second casing members that mate to form said body.

11. The multiple function lock of claim 1, wherein said heel portion can be independently released and moved relative to said body without unlocking both said first and second locking mechanisms.

12. The multiple function lock of claim 1, wherein said toe portion can be independently released and moved relative to said body without unlocking both said first and second locking mechanisms.

13. The multiple function lock of claim 1, wherein when said retaining cup is in said unlocked position, said toe portion of said shackle may rotate away from said body.

14. A multiple function lock comprising a body, a shackle having toe and heel portions, a first locking mechanism for securing said heel portion to said body and a separate independent second locking mechanism for securing said toe portion to said body, each of said first and second locking mechanisms being operable to be unlocked to unlock the lock by permitting the toe portion of the shackle to be unsecured and moved away from the body without unlocking the other of said first and second locking mechanisms, wherein said second locking mechanism comprises a stop member, said stop member having a plurality of upstanding blocks spaced apart to receive said toe portion therebetween, said retaining member being moveable between an unlocked position at which said toe portion is free to rotate about said heel portion and a locked portion at which at least one of said blocks restricts rotation of said toe portion.

15. The multiple function lock of claim 14, wherein at least one of said locking mechanisms is a keyed cylinder.

16. The multiple function lock of claim 14, wherein at least one of said locking mechanisms is a combination lock.

17. The multiple function lock of claim 15, wherein actuation of said keyed cylinder causes rotation of said second locking mechanism.

18. The multiple function lock of claim 14, wherein the plurality of upstanding blocks comprises two blocks.

* * * * *